US009327183B1

(12) United States Patent
Hong et al.

(10) Patent No.: US 9,327,183 B1
(45) Date of Patent: May 3, 2016

(54) METHOD, SYSTEM AND DEVICE FOR CONDUCTING A POKER-TYPE WITH PLAYER DISCARDS

(71) Applicants: Hwei-Wen Wayne Hong, Alameda, CA (US); Ivan Hong, Alameda, CA (US)

(72) Inventors: Hwei-Wen Wayne Hong, Alameda, CA (US); Ivan Hong, Alameda, CA (US)

( * ) Notice: Subject to any disclaimer, the term of this patent is extended or adjusted under 35 U.S.C. 154(b) by 74 days.

(21) Appl. No.: 14/198,536

(22) Filed: Mar. 5, 2014

Related U.S. Application Data

(63) Continuation-in-part of application No. 13/901,416, filed on May 23, 2013, now abandoned.

(60) Provisional application No. 61/903,569, filed on Nov. 13, 2013, provisional application No. 61/771,892, filed on Mar. 3, 2013.

(51) Int. Cl.
*A63F 13/00* (2014.01)
*A63F 1/00* (2006.01)

(52) U.S. Cl.
CPC ..... *A63F 1/00* (2013.01); *A63F 2001/005* (2013.01)

(58) Field of Classification Search
CPC A63F 1/00; A63F 2001/005; A63F 2001/008
USPC ..... 463/11, 13, 25; 273/292
See application file for complete search history.

(56) References Cited

U.S. PATENT DOCUMENTS

| | | | | |
|---|---|---|---|---|
| 6,102,402 | A * | 8/2000 | Scott et al. | 273/292 |
| 6,896,265 | B1 * | 5/2005 | Schlumbrecht | 273/292 |
| 7,108,265 | B1 * | 9/2006 | Dargue | 273/292 |
| 2006/0027969 | A1 * | 2/2006 | Schultz | 273/292 |
| 2009/0250878 | A1 * | 10/2009 | Moss | 273/292 |
| 2012/0196665 | A1 * | 8/2012 | Sparago | 463/13 |

* cited by examiner

*Primary Examiner* — Allen Chan
(74) *Attorney, Agent, or Firm* — Muskin & Farmer LLC

(57) ABSTRACT

A method for conducting a game includes receiving an ante wager and optional side wagers. A player hand, a dealer hand, and a community set are dealt. A first option is conducted for the player to place a raise wager or check. After the first option, a portion of the community set is exposed, followed by a second option to place a raise wager or check, unless a raise wager was previously received. A portion of the dealer hand is exposed, followed by a third option to place a raise wager or fold, unless a raise wager was previously received. The remainder of the community set and dealer hand are exposed, a final player hand and final dealer hand are formed, and wagers are resolved based on a comparison of the final player hand to the final dealer hand, and whether the final dealer hand has a qualifying holding.

19 Claims, 8 Drawing Sheets

METHOD, SYSTEM AND DEVICE FOR CONDUCTING A POKER-TYPE WITH PLAYER DISCARDS

CROSS REFERENCE TO RELATED APPLICATIONS

This application is a continuation in part of application Ser. No. 13/901,416 (which is incorporated by reference herein in its entirety) which claims benefit to U.S. Provisional Application Ser. No. 61/771,892 (which is incorporated by reference herein in its entirety), entitled "Method, Apparatus, and Computer Readable Storage for Implementing a Stud Poker Game," filed Mar. 3, 2013. This application also claims benefit to U.S. provisional application 61/903,569, which is incorporated by reference herein in its entirety.

FIELD OF THE INVENTION

The present invention relates to methods, systems, and devices for conducting wagering games. More particularly, the present invention is a method, system, and device for conducting a wagering game in which at least a portion of a community set and dealer hand are exposed during the course of a game, prior to receiving a raise wager or a decision to fold.

BACKGROUND OF THE INVENTION

A well-known family of poker games is hold'em poker. In hold'em poker, multiple players compete against one another to win a player-funded pot. Generally, hold'em poker games include one or more shared cards, referred to as community cards, that are used in conjunction with individual player cards to form a player hand. Among the games in this family are Texas Hold'em, Omaha Hold'em, and Pineapple (sometimes referred to as "Pineapple Hold'em" or "Crazy Pineapple").

Texas Hold'em is considered the most popular community card game. In the most common version, Texas Hold'em is played by as many as ten players using a single standard deck of fifty-two playing cards. In private games, it is typical to use ante bets to fund the pot; in poker room games, "blind" bets, that is, bets placed by a player before the player sees his cards, are used to initially fund the pot.

Each player is dealt a player hand of two cards face down. These cards are used exclusively by the recipient and may be referred to as hole cards or pocket cards.

After the player hands have been dealt, a round of betting takes place. In an embodiment utilizing blind bets, a player may only fold (i.e., withdraw from the game), call (i.e., match the current wager), or raise (i.e., increase the current wager). In an embodiment utilizing ante bets, a player has the option to bet (i.e., set the opening bet if no prior bets have been made), check (i.e., pass if no prior bets have been made), call, raise, or fold.

After the first betting round, the dealer deals three community cards face-up. This is sometimes referred to as "the flop." Another round of betting follows the flop. In the second and subsequent betting rounds, players have the option to bet or call, check, raise, or fold.

After the second betting round, a fourth community card is dealt. The fourth community card is sometimes referred to as "the turn" or "Fourth Street." Yet another round of betting occurs.

After the third betting round, the dealer reveals a final community card, called "the river" or "Fifth Street." A final betting round precedes the showdown. At showdown, all remaining players (i.e., players who have not folded) reveal their cards. Each player plays the highest ranking five-card poker hand possible using any combination of the five community cards and the two cards in his or her player hand. In forming a poker hand, the player may use zero, one, or both cards in his or her player hand in conjunction with five, four, or three of the community cards, respectively. The player with the highest ranking poker hand wins the pot.

Omaha Hold'em is similar to Texas Hold'em except the player is dealt a player hand with four hole cards rather than two. After five community cards are dealt and exposed (with attendant betting rounds), the player uses exactly two (no more or less) of his four hole cards plus exactly three of the community cards to form a five-card poker hand.

Pineapple is also similar to Texas Hold'em with two substantive differences. In Pineapple, each player is dealt a player hand with three hole cards rather than two. A first betting round follows, then three community cards are dealt (the "Flop"). A second betting round occurs. Each player is then required to discard one card from his player hand and proceed with the two remaining cards. The discarded cards are removed from play and cannot be used. Play continues as in Texas Hold'em.

SUMMARY OF THE INVENTION

The present invention includes a method, system, and device for conducting a game for at least one player. In an optional embodiment, a device includes a random outcome generator to produce random outcomes using playing cards. In one optional embodiment, the random outcome generator operates using physical playing cards, such as a card shuffler or card randomizer. In another optional embodiment, the random outcome generator operates on electronic versions of playing cards. In one such optional embodiment, a device may include a data processor, a display in communication with the data processor, a player interface in communication with the data processor, and a data storage device in communication with the data processor. The random outcome generator may be software or firmware executed by the data processor, or hardware operating in cooperation with the data processor.

In an optional embodiment, the data storage device stores program instructions executable by the data processor to conduct a method according to an embodiment of the present invention. In a further optional embodiment, described in greater detail below, the data storage device may also store a bad beat pay table correlating final player hands and bad beat payouts and/or a bonus pay table correlating bonus combinations with bonus payouts.

According to a method of the present invention, an ante bet is received for eligibility for play of the game. In an optional embodiment, the ante bet is received through the player interface. In a further optional embodiment incorporating a bad beat side game and/or a bonus side game, a bad beat side wager and/or a bonus side wager may be received. In an optional embodiment, a bad beat side wager and/or a bonus side wager may be received through the player interface.

A player hand of playing cards is dealt by the random outcome generator. Similarly, an unexposed dealer hand containing a plurality of playing cards and an unexposed community set containing a plurality of playing cards are dealt by the random outcome generator.

A first option is received whether to place a raise bet equal to a first multiple or check. The first option occurs after the player hand is dealt but prior to exposing any portion of the unexposed dealer hand and the unexposed community set. In an optional embodiment, the first option may be received through a player interface.

A portion of the community set is exposed. In an optional embodiment conducted on a device, the community set may be exposed at the display. The portion of the community set that is exposed includes at least one, but fewer than all, the playing cards of the community set. The community set is partially exposed after the first election is received but prior to exposing the unexposed dealer hand.

A second option is received through the player interface whether to place a raise bet or check. The second option is only received from players who did not opt to place a raise bet at the first option. Put another way, the second option is received from each player who opted to check at the first option. The raise bet at the second option is equal to a second multiple which is less than the first multiple. The second option occurs after a portion of the community set is exposed but prior to exposing the unexposed dealer hand.

A portion of the dealer hand is exposed. In an optional embodiment, the dealer hand is partially exposed at the display. The portion of the dealer hand that is exposed, includes at least one, but fewer than all, the playing cards of the dealer hand. The dealer hand is partially exposed after the second election is received.

A third option is received whether to place a raise bet or fold. The third option is only received from players who did not opt to place a raise bet at the first option or the second option. Put another way, the third option is received from players who opted to check at both the first option and the second option. The raise bet at the third option is equal to a third multiple which is less than the second multiple. The third option occur after a portion of the community set is exposed and after a portion of the dealer hand is exposed but prior to exposing the entire community set and exposing the entire dealer hand.

All remaining unexposed playing cards of the community set and the dealer hand are exposed. In an optional embodiment, the remaining playing cards of the community set and dealer hand are exposed at the display.

A final dealer hand is formed using playing cards of the dealer hand in combination with playing cards of the community set. Similarly, a final player hand is formed using playing cards of the player hand in combination with playing cards of the community set. In an optional embodiment, one or both of the final dealer hand and/or final player hand may be formed by the data processor.

The final dealer hand is compared to the final player hand and, in an optional embodiment, to a predetermined qualifying hand ranking. In an optional embodiment, the final dealer hand may be compared to the final player hand and/or the predetermined qualifying hand ranking by the data processor.

The first wager is returned and a payout is issued based on the second wager when the final dealer hand is lower than the qualifying hand ranking and the final player hand outranks the final dealer hand. In an optional embodiment, the payout based on the second wager is determined according to a predefined pay table of final player hands correlated to payouts.

The first wager is returned and the second wager is collected when the final dealer hand is lower than the qualifying hand ranking and the final dealer hand outranks the final player hand.

Payouts are issued based on the first wager and the second wager when the final dealer hand is equal to, or higher than, the qualifying hand ranking and the final player hand outranks the final dealer hand. In an optional embodiment, the payout based on the second wager is determined according to a predefined pay table of final player hands correlated to payouts.

The first wager and the second wager are collected when the final dealer hand is equal to, or higher than, the qualifying hand ranking and the final dealer hand outranks the final player hand.

In an optional embodiment including a bad beat side game, a bad beat payout may be issued based on the bad beat side wager when (a) a final player hand is correlated to a bad beat payout according to a bad beat pay table and (b) the final dealer hand outranks the final player hand.

In an optional embodiment including a bonus side game, a bonus payout may be determined first by determining whether the combination of playing cards exposed during the steps of exposing a portion of the community set and exposing a portion of the dealer hand form a bonus combination according to the bonus pay table. In an optional embodiment, the determination is made by the data processor. A bonus payout is issued if the combination of playing cards exposed during the steps of exposing a portion of the community set and exposing a portion of the dealer hand form a bonus combination according to the bonus pay table. The bonus payout issued is the amount correlated to the bonus combination based on the bonus side wager.

DESCRIPTION

Figure 1:
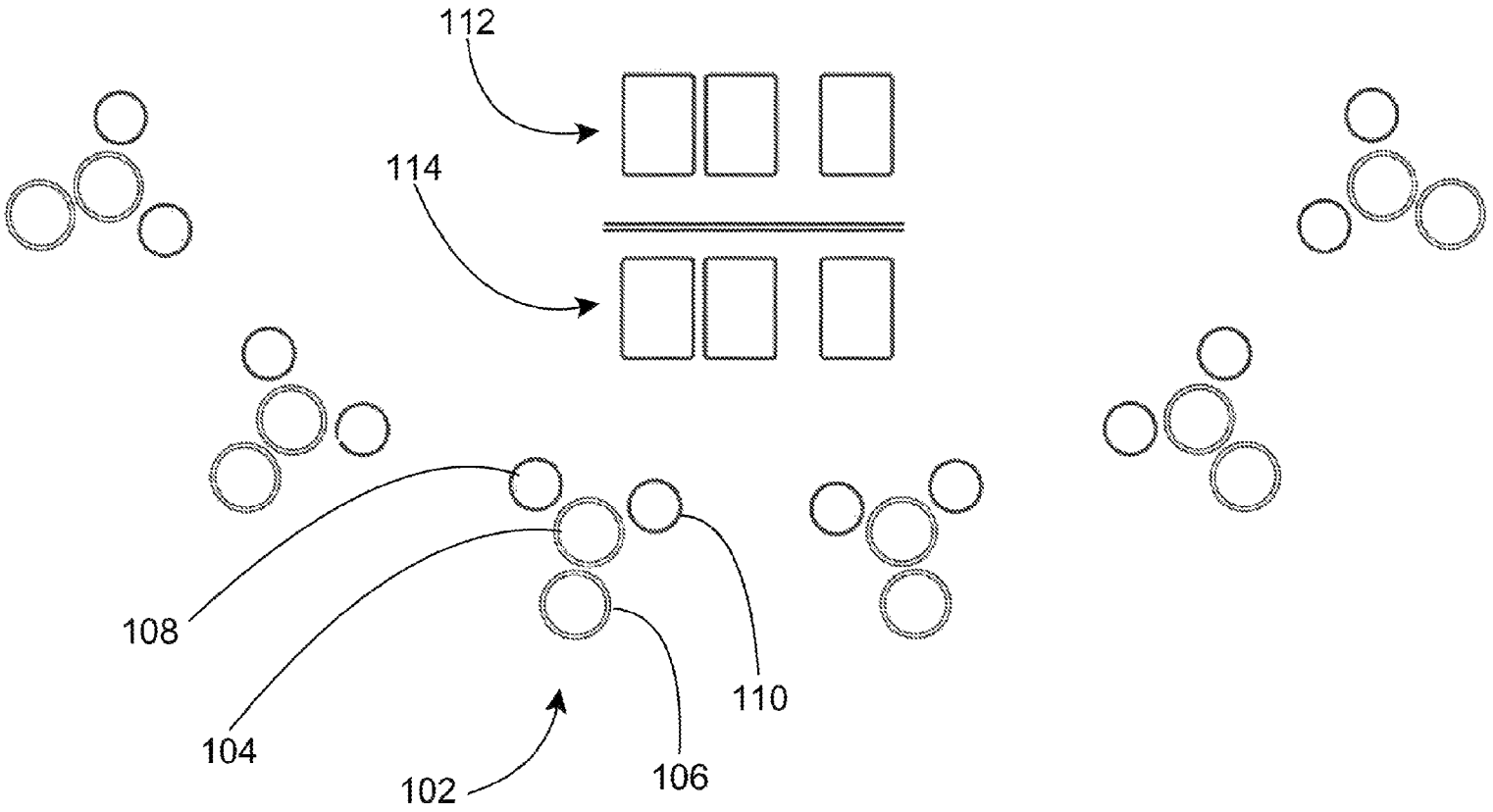
FIG. 1 is a top view of a table layout to assist in conducting a method according to an embodiment of the present invention.
Figure 2:
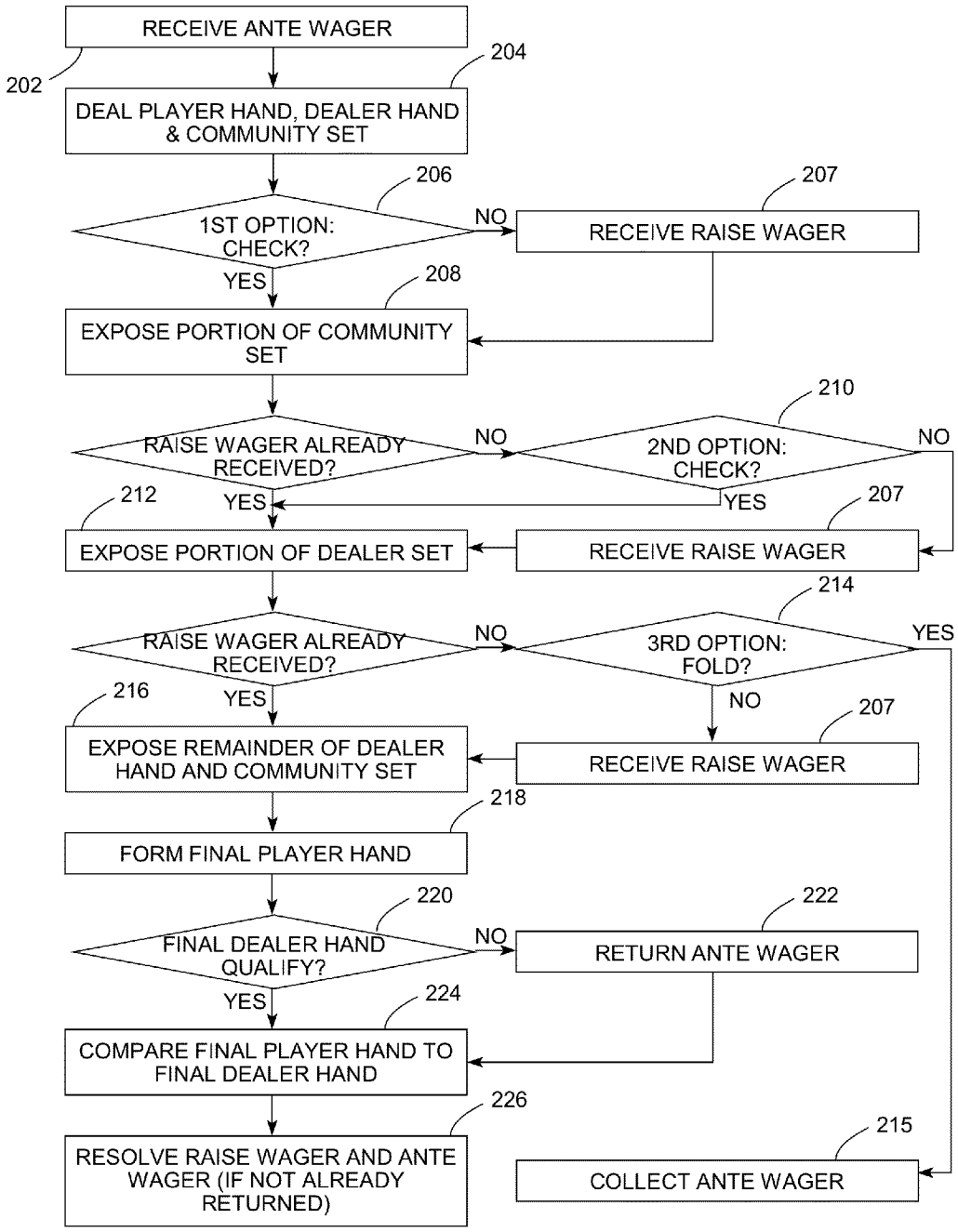
FIG. 2 is a flow chart of a method according to an embodiment of the present invention.
Figure 3:
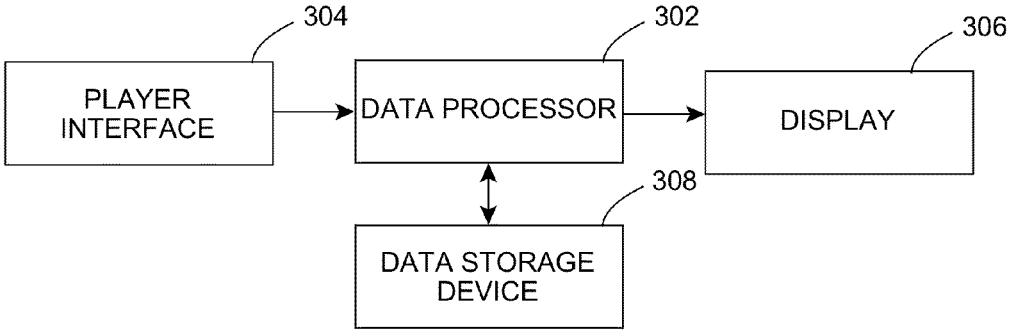
FIG. 3 is a block diagram of a device according to an embodiment of the present invention.

Reference is now made to the figures wherein like parts are referred to by like numerals throughout. As illustrated in FIGS. 1-3, the present invention is directed to a method, system, and device for conducting a casino wagering game.

Although examples below describe embodiments of the present invention utilizing conventional playing cards, e.g., playing cards marked deuce through ten, jack, queen, king, and ace in four suits, it is contemplated that the present invention could be conducted with other forms of playing cards. Similarly, embodiments of the present invention could utilize any other type of game pieces, such as dominoes or tiles.

The present invention could by directed to any quantity of cards. Thus, although the examples below are generally directed to a five-card stud poker game, it is contemplated that the final hands may be formed from any quantity of cards, such as seven cards.

It is also contemplated that the present invention could be conducted using any deck constitution of playing cards, such as a conventional fifty-two card poker deck, a supplemented deck that includes additional cards such as a Joker, a truncated deck that omits cards such as a Spanish deck, or any other deck constitution. Similarly, the present invention could be conducted using a single deck, or multiple decks. The examples given below are directed to a single fifty-two card poker deck, but this should be interpreted as illustrative rather than limiting.

The present game may be conducted at a live table using physical playing cards or an electronic device. An example of a table layout for conducting a game at a live or electronic table is illustrated in FIG. 1 and an example of an electronic device for conducting a game at an electronic device is illustrated in FIG. 3.

In an optional embodiment conducted using a live or electronic table, a table layout such as that illustrated in FIG. 1 may include multiple player areas 102 each having an "Ante" bet area 104, "Raise" bet area 106, "4 Up Cards" bet area 108, and "Player Bad Beat" bet area 110. In an optional embodiment, a table layout may also include a dealer hand area 112 and community set area 114. In the optional embodiment of FIG. 1, the dealer hand area 112 and community set area 114 include markings for individual cards within the dealer hand and community set, respectively, to identify the order in which cards are exposed during the game. For example, two card areas of the community set area 114 are marked "I" to indicate they are exposed first (i.e., after a first option described in greater detail below), two card areas of the dealer hand area 112 are marked "II" to indicate they are exposed second (i.e., after a second option described in greater detail below), and one card area of each of the dealer hand area 112 and community set area 114 are marked "III" to indicate they are exposed third (i.e., after a third option described in greater detail below).

Relatedly, the present invention may be conducted manually or using a device. In an optional embodiment utilizing a device, a random outcome generator may be used to produce random outcomes. In an optional embodiment in which the game is conducted using physical playing cards, the random outcome generator may take the form of a card shuffler that uses a random number generator to randomize the playing cards of a deck. In an optional embodiment, the random outcome generator in the form of a card shuffler may also deal hands by assembling random sets of cards and dispensing the cards together as a hand.

Alternatively, embodiments of the present invention may be conducted using an electronic device with playing cards represented by computer-generated graphics. In such an optional embodiment, playing cards may be randomized and dealt by a data processor 302 working in cooperation with, or executing, a random number generator. It is contemplated that such a random number generator may take the form of hardware (e.g., an embedded device), firmware, or software.

Referring to FIG. 2, in an optional embodiment, a first wager (which may be referred to as an "ante bet") is received 202 from each player. Each player is dealt 204 a player hand, optionally using the random outcome generator to randomize the playing cards dealt to the player hand. In an optional embodiment, a player hand contains two playing cards.

A dealer hand is dealt 204. Again, in an optional embodiment, a random outcome generator may randomize the playing cards dealt to the dealer hand. The phrase "dealer hand" should be interpreted as describing the hand conducted by, and attributed to, the game operator competing against the players. In this regard, the dealer hand may be conducted by a live dealer, a live banker, a live player-banker, an electronic device, or the like. In an optional embodiment, the dealer hand may contain any quantity of playing cards. In one example, the dealer hand may contain the same quantity of playing cards as the player hand. In another example, the dealer hand may contain more playing cards than the player hand. In an optional embodiment illustrated in the figures, the player hand contains two playing cards and a dealer hand contains three playing cards, all of which are dealt unexposed.

A community set is dealt 204, optionally using a random outcome generator to randomize the playing cards dealt to the community set. In an optional embodiment, the community set includes three playing cards, all of which are dealt unexposed. It is contemplated that any of the player hand, dealer hand, and/or community set may contain any quantity of cards, depending on the optional embodiment.

After the player hands are dealt, but before exposing any of the playing cards in the dealer hand and/or community set, a first option is received 206 from each player. In the first option, an election is received to either place a second wager (optionally referred to as a "raise bet") or check (i.e., proceed in the game without making a second wager at that point in the game). If an election is received to place 207 a raise bet, the raise bet is equal to a first multiple. The first multiple may be any size. In an optional embodiment, the first multiple is alternative at the player's option. For example, the first multiple may be three or four times the ante bet, at the player's option.

After receiving an election from each player to either place a second wager or check, a portion of the community set is exposed 208. The term "portion" refers to at least one, but fewer than all, of the playing cards of the community set. Thus, in the example in which the community set includes three playing cards, a "portion" could refer to the exposure of one or two of the playing cards in the community set. In an optional embodiment, two of the three community cards are exposed.

After exposing a portion of the community set but before exposing any of the dealer hand, a second option is received 210 from those players who opted to check at the first option. That is, a second option cannot be exercised by any player who opted to place a raise bet at the time of the first option. The second option is similar to the first option in that an election is received whether to place a second wager (optionally referred to as a "raise bet") or check. If an election is received to place 207 a raise bet, the raise bet is equal to a second multiple. In an optional embodiment, the second multiple is less than the first multiple. Stated differently, the raise bet that may be placed at the second option may be less than the raise bet that may be placed at the first option. In an optional embodiment, the second multiple is two times the ante bet.

A portion of the dealer hand is exposed 212 after the second option. Again, the word "portion" refers to at least one, but fewer than all, the playing cards in the dealer hand. In an optional embodiment in which the dealer hand contains three playing cards, the portion of the dealer hand that is exposed contains two playing cards.

A third option is conducted after a portion of both the community set and the dealer hand have been exposed. At the third option, an election is received 214 whether to place a second wager (optionally referred to as a "raise bet") or fold. Again, the third option is unavailable to any player who previously placed a raise bet. Stated differently, the third option is only available to players who checked at the first option and second option. In the third option, the raise bet is equal to a third multiple. In an optional embodiment, the third multiple is less than the first multiple and second multiple. For example, in an optional embodiment in which the second multiple is two times the ante bet, the third multiple may be one times the ante bet (i.e., in the third option, the raise bet is equal to the ante bet). If an election is received to fold, play of the game is terminated for the player and the player's ante bet is collected. In an optional embodiment (discussed in greater detail below), certain side bets may be collected when the player elects to fold, while other side bets remain in action.

All unexposed playing cards of the community set and dealer hand are exposed 216. In one example, the community set and dealer hand each contain three playing cards, with two playing cards of the community set exposed prior to conducting a second option and two playing cards of the dealer hand exposed prior to conducting a third option. In such an optional embodiment, one remaining playing card from each of the community set and the dealer hand is exposed after the third option is conducted.

A final player hand is formed 218 from the combination of playing cards in the player hand combined with the community set. In one example embodiment, the player hand contains two playing cards, the community set contains three playing cards, and the final player hand contains all five playing cards from the combination of the player hand and the community set. In such an optional embodiment, the final player hand is essentially a five-card stud poker hand, without the option to disregard, discard, and/or replace any of the playing cards available to form the final player hand.

In alternate optional embodiments, a different quantity of playing cards may be dealt to the player hand and/or the community set. For example, the community set could contain five playing cards and the player hand could contain two playing cards, similar to the configuration used in hold'em-style poker games. In such optional embodiments, the final player hand may be unconstrained in the quantity of playing cards used from the player hand, or the final player hand may be constrained to use a fixed quantity of (including, optionally, all) the playing cards from the player hand. However, it is contemplated that any quantity of playing cards may be dealt to either the player hand and/or community set and/or used to form a final player hand.

A final dealer hand is formed 218. In an optional embodiment, the dealer hand contains three playing cards and the community set contains three playing cards to form a five-card poker hand. Thus, in such an example, two of the playing cards from the dealer hand are selected for combination with three playing cards of the community set to form a final dealer hand. It is contemplated that the dealer hand may contain any quantity of playing cards, and the final dealer hand may contain any quantity of playing cards. Moreover, while the present example embodiment includes three playing cards within the dealer hand, two of which must be used, it is contemplated that the dealer hand may include any quantity of cards, with any restrictions or requirements about the quantity of cards that are used in forming the final dealer hand. For example, a dealer hand could include exactly two playing cards, both of which must be used in forming the final dealer hand or could include any quantity greater than two playing cards, from which two playing cards are selected for use in the final dealer hand.

In an optional embodiment, the final dealer hand is examined to determine 220 whether the final dealer hand holds a qualifying holding. In an optional embodiment, the resolution 222 of ante bets depends, at least in part, on whether the final dealer hand qualifies. For example, in one optional embodiment, the qualifying holding is any holding greater than, or equal to, an ace-king high. Thus, qualifying holdings include any hand containing an ace and king or any of the higher ranked holdings (e.g., pair, two pair, three of a kind, etc.). Any other final dealer hand would not qualify in such an example. If the final dealer hand fails to include a qualifying holding, the first wagers (e.g., ante bets) are returned (i.e., push). If the final dealer hand contains a qualifying holding, the ante bets are resolved based on a comparison between the final player hand and final dealer hand, with the ante bet paid (optionally even money or 1 to 1) if the final player hand outranks the final dealer hand or collected if the final dealer hand outranks the final player hand.

The final dealer hand is compared 224 to each final player hand to resolve 226 each raise bet and each ante bet not previously returned. It is noted that even when the dealer hand fails to qualify, a final dealer hand is compared to the final player hand to resolve raise bets. In an optional embodiment, the comparison between the final player hand and final dealer hand is based on conventional five-card poker hand rankings (e.g., in ascending order, high card, pair, two pair, three of a kind, straight, flush, full house, four of a kind, straight flush, royal flush). However, it is contemplated that any hand ranking system may be used, including the sum of the values of the cards (as in baccarat and blackjack), tile combinations (as in pai gow), or any other hand ranking system. If the final player hand outranks the final dealer hand, raise wagers are paid based on a predefined pay table. If the final dealer hand outranks the final player hand, raise wagers are collected. If the final player hand and final dealer hand tie, the raise wager may be returned (i.e., push). In alternate optional embodiments, tied hands may alternatively result in a loss of part or all of the raise wager (i.e., dealer wins ties) or a payout based on the raise wager (i.e., player wins ties). The predefined pay table correlates final player hands to payouts. Table 1 illustrates one example of a pay table that may be used to determine the payout for winning final player hands.

TABLE 1

| Final Player Hand | Payout |
|---|---|
| Royal Flush | 100 to 1 |
| Straight Flush | 50 to 1 |
| Four of a Kind | 25 to 1 |
| Full House | 9 to 1 |
| Flush | 7 to 1 |
| Straight | 5 to 1 |
| Three of a Kind | 3 to 1 |
| Two Pair | 3 to 2 |
| One Pair or High Card | 1 to 1 |

The example of Table 1 should be interpreted as illustrative rather than limiting. For example, in another optional embodiment, a pay table such as that shown in Table 2, Table 3, or Table 4 may be used.

TABLE 2

| Final Player Hand | Payout |
|---|---|
| Royal Flush | 100 to 1 |
| Straight Flush | 50 to 1 |
| Four of a Kind | 20 to 1 |
| Full House | 8 to 1 |
| Flush | 7 to 1 |
| Straight | 5 to 1 |
| Three of a Kind | 3 to 1 |
| Two Pair | 3 to 2 |
| One Pair or High Card | 1 to 1 |

TABLE 3

| Final Player Hand | Payout |
|---|---|
| Royal Flush | 100 to 1 |
| Straight Flush | 50 to 1 |
| Four of a Kind | 10 to 1 |
| Full House | 6 to 1 |
| Flush | 5 to 1 |
| Straight | 4 to 1 |
| Three of a Kind | 3 to 1 |
| Two Pair | 2 to 1 |
| One Pair or High Card | 1 to 1 |

TABLE 4

| Final Player Hand | Payout |
|---|---|
| Royal Flush | 250 to 1 |
| Straight Flush | 50 to 1 |
| Four of a Kind | 40 to 1 |
| Full House | 9 to 1 |
| Flush | 7 to 1 |
| Straight | 5 to 1 |
| Three of a Kind | 2 to 1 |
| Two Pair | 3 to 2 |
| One Pair or High Card | 1 to 1 |

According to an embodiment of the present invention, the ante bet is automatically returned if the dealer hand fails to qualify, and is resolved based on a comparison of the final player hand to the final dealer hand if the dealer hand qualifies. The raise bet always receives action regardless of whether the dealer hand qualifies. To summarize the optional embodiment described above, when a dealer hand qualifies and the final player hand outranks the final dealer hand, both the ante bet and the raise bet are paid, with the ante bet optionally paid a fixed amount, such as even money, and the raise bet paid based on a predetermined pay table. When a dealer hand fails to qualify and the final player hand outranks the final dealer hand, the ante bet is returned and the raise bet is paid based on a predetermined pay table. When a dealer hand qualifies and the final dealer hand outranks the final player hand, both the ante bet and the raise bet are collected. When a dealer hand fails to qualify and the final dealer hand outranks the final player hand, the ante bet is returned and the raise bet is collected. When the final dealer hand ties the final player hand, the raise bet is returned, i.e., a push occurs. These outcomes are summarized in Table 5.

TABLE 5

| Final Dealer Hand Qualification | Final Player Hand and Final Dealer Hand Comparison | Outcome: Ante | Outcome: Raise |
|---|---|---|---|
| Final dealer hand qualifies | Final player hand outranks final dealer hand | Paid | Paid |
| Final dealer hand qualifies | Final dealer hand outranks final player hand | Collected | Collected |
| Final dealer hand qualifies | Final player hand ties final dealer hand | Returned | Returned |
| Final dealer hand does not qualify | Final player hand outranks final dealer hand | Returned | Paid |
| Final dealer hand does not qualify | Final dealer hand outranks final player hand | Returned | Collected |
| Final dealer hand does not qualify | Final player hand ties final dealer hand | Returned | Returned |

For example, as applied according to one optional embodiment, an ante bet is received and a player hand of A-spades/J-spades is dealt. Because of the value of the player hand, a player may elect to place a raise bet at the first option if the first multiple is greater than the second or third multiple. In this example, the player may elect a first multiple of three or four times the ante bet when placing the raise bet. In this case, the player may elect to place a raise bet of four times the ante bet based on the strength of the player hand.

A portion of the community set is exposed to reveal 9-hearts/3-hearts. Since a raise wager was placed at the first option, the second option and third option are not conducted for the player. However, in an embodiment in which the game is conducted for multiple players, the second and/or third option may be conducted for other players who did not elect to place a raise wager at the first option.

Continuing with the example, a portion of the dealer hand is exposed to reveal Q-hearts/2-clubs. Again, the third option need not be conducted for this particular player because a raise wager was elected and received during the first option.

The remaining unexposed playing cards from the community set and dealer hand are exposed to reveal a community set of 9-diamonds/3-hearts/K-clubs and a dealer hand of Q-hearts/2-clubs/A-hearts.

A final dealer hand is assembled containing the three playing cards of the community set plus two of the three playing cards in the dealer hand. In this example, the dealer hand contains A-hearts/K-clubs/Q-hearts/9-diamonds/3hearts. In an optional embodiment in which a qualifying holding is ace-king high, the dealer hand qualifies and the ante wager is paid.

A final player hand is also assembled using the player hand plus the community set. Again, as noted above, this example is directed to a five-card stud-style game and, thus, all of the playing cards available to the player are used. In this example, a player hand of A-spades/K-clubs/J-spades/9-diamonds/3-hearts is formed. Comparing the final player hand to the final dealer hand, the final dealer hand has the higher ranking and, thus, the ante bet and raise bet are collected. Conversely, if for example, if the player hand had contained 9-spades/5-clubs to produce a final player hand of K-clubs/9-diamonds/9-spades/5-clubs/3-hearts, the final player hand (pair of nines) would have outranked the final dealer hand (ace high) and both the ante bet and raise bet would have been paid.

In an optional embodiment, one or more side wagers may also be offered. For example, in one optional embodiment, a bonus side wager may be received at the commencement of the game. In one such optional embodiment, the portion of the community set exposed during the game (e.g., between the first option and the second option) is combined with the portion of the dealer set exposed during the game (e.g., between the second option and the third option). This combination of cards is compared to a bonus pay table that correlates bonus combinations and bonus payouts. If the combination of cards forms a bonus combination, the associated payout is issued based on each bonus side wager. Examples of bonus pay tables are illustrated in Tables 6 and 7. In the examples of Tables 6 and 7, the two cards exposed from the community set are combined with the two cards exposed from the dealer hand to form a four-card combination. Tables 6 and 7 should be interpreted as illustrative rather than limiting as the bonus combinations as well as the bonus payouts could be changed, added to, or deleted from.

TABLE 6

| Four-Card Combination | Payout |
|---|---|
| Royal Flush | 800 to 1 |
| Four of a Kind | 200 to 1 |
| Straight Flush | 80 to 1 |
| Three of a Kind | 10 to 1 |
| Straight | 8 to 1 |
| Two Pair | 6 to 1 |
| Flush | 4 to 1 |
| One Pair | 1 to 1 |

TABLE 7

| Four-Card Combination | Payout |
|---|---|
| Royal Flush | 800 to 1 |
| Four of a Kind | 200 to 1 |
| Straight Flush | 80 to 1 |
| Three of a Kind | 10 to 1 |
| Straight | 8 to 1 |
| Two Pair | 5 to 1 |
| Flush | 4 to 1 |
| One Pair | 1 to 1 |

In an additional or alternate optional embodiment, a bad beat side wager may be received at the commencement of the game. In one such optional embodiment, the bad beat side wager is paid based on a bad beat pay table when the final player hand loses (i.e., is outranked by the final dealer hand) but the final player hand contains a "bad beat holding" according to the bad beat pay table. Examples of bad beat pay tables are given below in Tables 8 and 9. Again, these pay tables should be viewed as illustrative rather than limiting as they payouts and/or bad beat holdings may be different in various alternate optional embodiments.

TABLE 8

| Losing Final Player Hand | Payout (to 1) |
|---|---|
| Straight | 10000 |
| Full House | 1000 |
| Flush | 500 |
| Straight | 300 |
| Three-of-a-Kind | 60 |
| Two Pair | 20 |
| Pair of Aces | 10 |
| Pair of Kings | 10 |
| Pair of Queens | 10 |
| Pair of Jacks | 10 |

TABLE 9

| Losing Final Player Hand | Payout (to 1) |
|---|---|
| Straight | 10000 |
| Full House | 1000 |
| Flush | 500 |
| Straight | 300 |

TABLE 9-continued

| Losing Final Player Hand | Payout (to 1) |
|---|---|
| Three-of-a-Kind | 80 |
| Two Pair | 15 |
| Pair of Aces | 10 |
| Pair of Kings | 10 |
| Pair of Queens | 10 |
| Pair of Jacks | 10 |

Referring to FIG. 3, an optional embodiment of the present invention may be conducted using a device. The electronic device may take any form, including a personal computer, tablet, mobile phone, handheld device, PDA, electronic gaming machine, electronic gaming table, mechanical gaming machine, kiosk, or the like. In one such optional embodiment illustrated in FIG. 3, an electronic device includes a data processor 302 in communication with a player interface 304 and a display 306. The data processor 302 also communicates with a data storage device 308, which stores game parameters, graphics, sounds, if any, and program instructions executable by the data processor 302 to conduct a game according to any embodiment of the present invention. It is contemplated that the electronic device may conduct a game according to an embodiment of the present invention for a single player playing against a computer-controlled dealer, multiple players (such as through a multi-terminal electronic device or a plurality of networked electronic devices) playing against a computer-controlled dealer, multiple players playing against a live dealer, multiple players playing against a live player-banker, or the like.

For example, in one optional embodiment, a first wager is received through a player interface 304. The player interface 304, for example, may include an input device, such as a touch screen, button panel, keyboard, keypad, pointer, mouse, or the like, that the player can operate to designate a wager. Additionally or alternatively, the player interface 304 may include a receiving device, such as a bill acceptor, ticket or voucher reader, coin receiver, or the like to receive payment for a wager and/or game credits usable for wagering. The first wager, optionally referred to as an ante wager, may be received through a player interface 304 prior to dealing or displaying any hands or cards. As above, an ante wager determines the player's eligibility in the game and, in an optional embodiment, receipt of the ante wager triggers the data processor 302 to initiate a game. Optionally, additional side wagers, such as the side wagers described above, may be selectable through the player interface 304.

The data processor 302 deals a player hand, a dealer hand, and a community set, optionally by operating a random number generator to randomly deal cards from a deck of playing cards stored at the data storage device 308. The data processor 302 displays at a display 306 the player hand while the playing cards of the dealer hand and community set are concealed.

A first option is conducted by receiving an election through the player interface 304 to check or place a second wager, optionally referred to as a raise wager. For example, a player interface 304 may include buttons or touch screen fields that read "Check" and "Raise Bet," and input from one of the buttons serves to designate the selected hand and place a raise bet in an amount equal to the first multiple (or further prompt selection of a multiple in an optional embodiment in which different options for first multiples are offered). In an optional embodiment in which the player interface 304 does not include a touchscreen, the election may be prompted at the display 306.

A data processor 302 exposes a portion of the community set at the display 306. A second option to either check or place a raise bet is conducted only if a raise bet was not placed during a first option, i.e., a second option is conducted if "check" was elected at the first option.

A portion of the dealer hand is exposed at the display 306. A third option to either fold or place a raise bet is conducted only if a raise bet was not placed during a first option or second option, i.e., a third option is conducted if "check" was elected at both the first option and second option. If an election to fold is received at the third option, the game is terminated and the ante bet is retained (or collected) by the data processor 302.

The data processor 302 forms a final player hand and final dealer hand according to the method described above. In an optional embodiment, the data processor 302 determines whether the final dealer hand contains a qualifying holding and resolves the ante wager accordingly (e.g., returns the ante wager when the final dealer hand fails to qualify and issuing a payout based on the ante wager when the final dealer hand qualifies).

Awards for a winning ante wager and raise wager may be added to a register of game credits stored in the device. Additionally or alternatively, the player interface 304 may include a dispensing device to dispense currency, coins, a ticket or voucher, or the like, representing the player's balance of stored game credits when the player desires to cash out.

Figure 4:
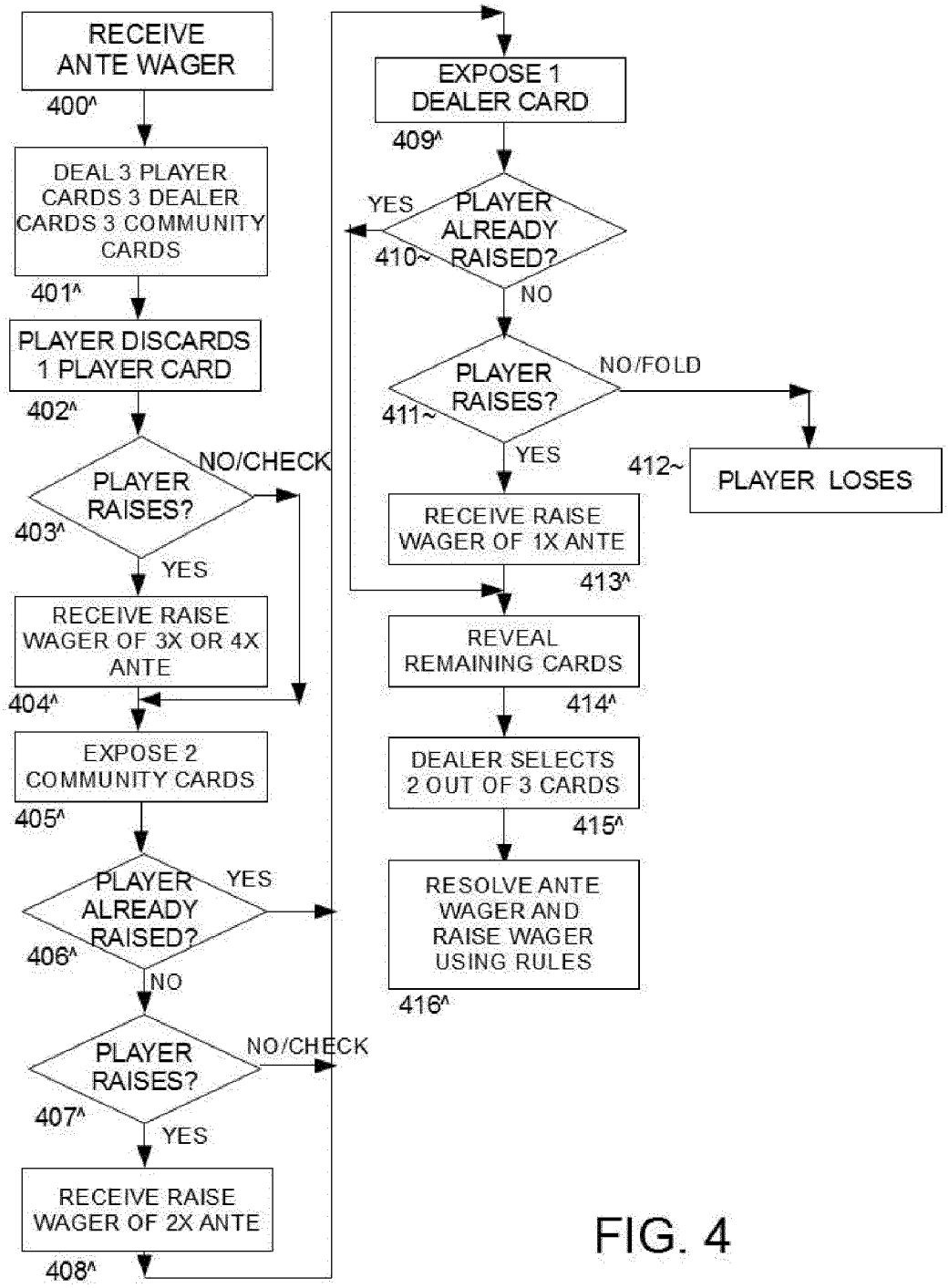
FIG. 4 is a flowchart illustrating an exemplary method of implementing an embodiment wherein the player can discard a card with three betting points, according to an embodiment.

FIG. 4 is a flowchart illustrating an exemplary method of implementing an embodiment wherein the player can discard a card with three betting points, according to an embodiment.

The method can begin with operation 400, which receives an ante wager from the player.

From operation 400, the method proceeds to operation 401, which deals three player cards (viewable by the player whether face up or face down), three dealer cards (face down), and three community cards (face down). Note that any other numbers of cards can be dealt to the player (i.e., 1 to 5 cards), dealer (i.e. 1 to 5 cards), and community (i.e. 1 to 5 cards) and the numbers described herein (3/3/3) are just one exemplary embodiment.

From operation 401, the method proceeds to operation 402 wherein the player discards one player card from the player's card (the player's hand) of the player's choosing. The player indicates which card to discard and the dealer can remove that card from the player's betting area.

From operation 402, the method proceeds to operation 403, wherein the player decides whether to raise or check. The player can raise (place an additional wager) or check (not place any additional wager) at this time.

If in operation 403, the player decides to raise, then the method proceeds to operation 404, wherein the player places a raise wager of three times or four times (at the player's choice) the ante wager (placed in operation 400). From operation 404, the method proceeds to operation 405.

If in operation 403 the player decides to check (not raise), then the player does not place an additional wager and the method proceeds to operation 405.

In operation 405, two community cards (out of the three) are exposed (turned face up). Any two of the cards can be used, although typically it would be the first two community cards dealt.

From operation 405, the method proceeds to operation 406, which determines whether the player has already raised (in operation 403). If the player has already raised (e.g., the method performed operation 404) then the method must proceed from operation 406 to operation 409 (because the player cannot raise twice).

If in operation 406, it is determined that the player did not already raise, then the method proceeds to operation 407, which determines whether the player raises. The player can choose whether to raise or check. If the player does not raise (checks) then the method proceeds to operation 409.

If in operation 407, it is determined that the player raises, then the method proceeds to operation 408 which receives a raise wager of two times the ante from the player. The method then proceeds to operation 409.

In operation 409, one of the dealer's cards is exposed (turned face up) while the other dealer's cards (two in this embodiment) remain face down an unknown to the players.

From operation 409, the method proceeds to operation 410, which determines whether the player has already raised (in either operations 403 or 406). If the player has already raised, then the method proceeds to operation 414 (because the player cannot raise twice).

If in operation 410, it is determined that the player has not already raised, then the method proceeds to operation 411, which determines whether the player raises or not. If the player does not raise, then the method proceeds to operation 412, wherein the player loses the ante wager and the game ends (in other words, the player folds).

If in operation 411, the player raises, then the method proceeds to operation 413, which receives a raise wager of one times the ante (in other words equal to the ante).

From operation 413, the method proceeds to operation 414, which reveals all of the remaining face down cards on the table (in other words all cards are turned face up, including all community, players, and dealers cards).

From operation 414, the method proceeds to operation 415, wherein the dealer selects two cards out of the dealer's three cards to use (in other words the dealer discards one of the dealer's cards).

From operation 415, the method proceeds to operation 416, which resolves the ante wager and raise wager according to predetermined rules. The predetermined rules are described above, for example see Table 5. The dealer's hand (formed of exactly five cards formed using the dealer's two cards and the three community cards) would qualify if it has a rank of at least ace-king and would not qualify if the dealer's rank is less than ace-king. The player's hand (formed of exactly five cards) is formed using the player's two cards and the three community cards. If the dealer does not qualify, then the ante wager pushes. If the dealer does qualify, then the ante wager is paid in the same manner as the raise wager (in other words if the raise wager wins then the ante wager wins even money, if the raise wager loses then the ante wager loses, and if the raise wager pushes then the ante wager pushes). A poker rank of the player's hand and a poker rank of the dealer's hand is determined. The higher rank wins, so that if the poker rank of the player's hand is higher than the poker rank of the dealer's hand then the player wins and the raise wager is paid to the player (typically at even money although bonus payouts can be made for certain hands). If the poker rank of the player's hand is lower than the poker rank of the dealer's hand then the dealer wins (and the raise wager is taken from the player). If the poker rank of the player's hand ties the poker rank of the dealer's hand then the raise wager pushes (neither wins nor loses).

Note that the dealer's hand (the dealer's final hand) must include all three community cards and the dealer's discard is only one of the dealer's initial three cards. For example, if the dealer is dealt three of a kind the dealer must discard one of these when forming the dealer's hand (formed of exactly five cards). If the community cards are three-spades/four-hearts/ace-hearts and the dealer's cards are five-spades/six-diamonds/seven-spades, the dealer cannot make a straight because the dealer must use all three community cards and discard one of the dealer's cards.

Figure 5:
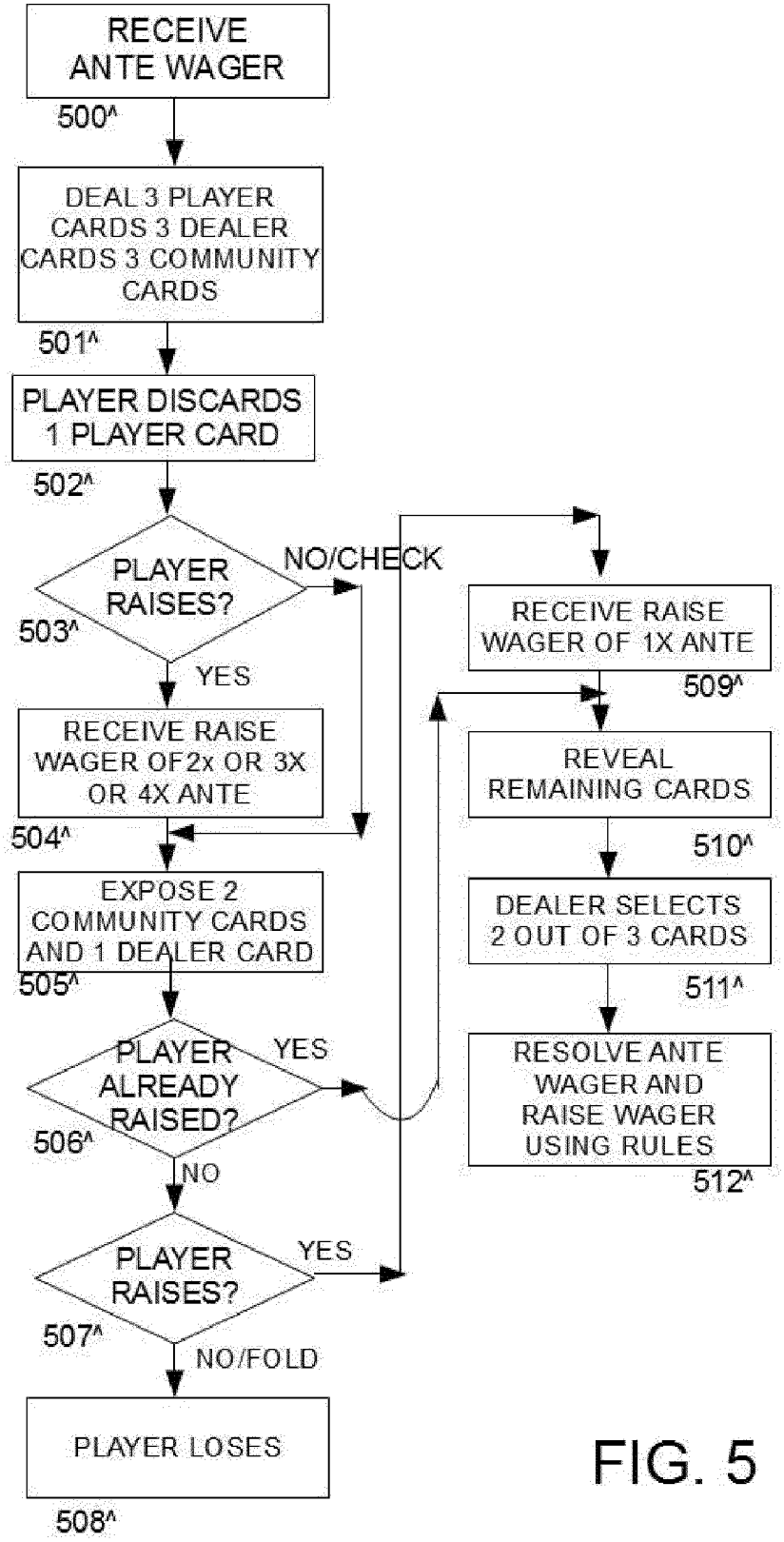
FIG. 5 is a flowchart illustrating an exemplary method of implementing an embodiment wherein the player can discard a card with two betting points, according to an embodiment.

FIG. 5 is a flowchart illustrating an exemplary method of implementing an embodiment wherein the player can discard a card with two betting points, according to an embodiment.

Operations 500, 501, 502, 503, and 504 are performed identically to operations 400, 401, 402, 403 and 404, respectively.

In operation 505, two community cards are exposed (can be any of the two community cards but is typically the first two community cards dealt) and one dealer's card (can be any one of the three dealer's cards although typically it is the first dealer's card dealt) is exposed. "Exposed" means turned face up.

From operation 505, the method proceeds to operation 506, which determines whether the player has already raised in operation 503. If the player has already raised, then the player cannot raise again and thus the method proceeds to operation 510.

If in operation 506 it is determined that the player has not already raised, then the method proceeds to operation 507 which determines whether the player raises. If the player decides not to raise, then the method proceeds to operation 508 in which the player loses the ante wager (the player folds).

If in operation 507, the player raises, then the method proceeds to operation 509, which receives a raise wager of one times the ante from the player.

From operation 509, the method proceeds to operation 510. Operations 510, 511, and 512 are performed identically to operations 414, 415, and 416 respectively.

Note that in an alternative embodiment, any card that is dealt face down can instead not be dealt at all until it is time to reveal (expose) that card and then it can be dealt face up. The player always has full decision making power to determine whether to raise (and by how much), check or fold. "Wager" and "bet" are used herein synonymously and can be interchanged (e.g., "ante wager" means the same as "ante bet").

Figure 6:
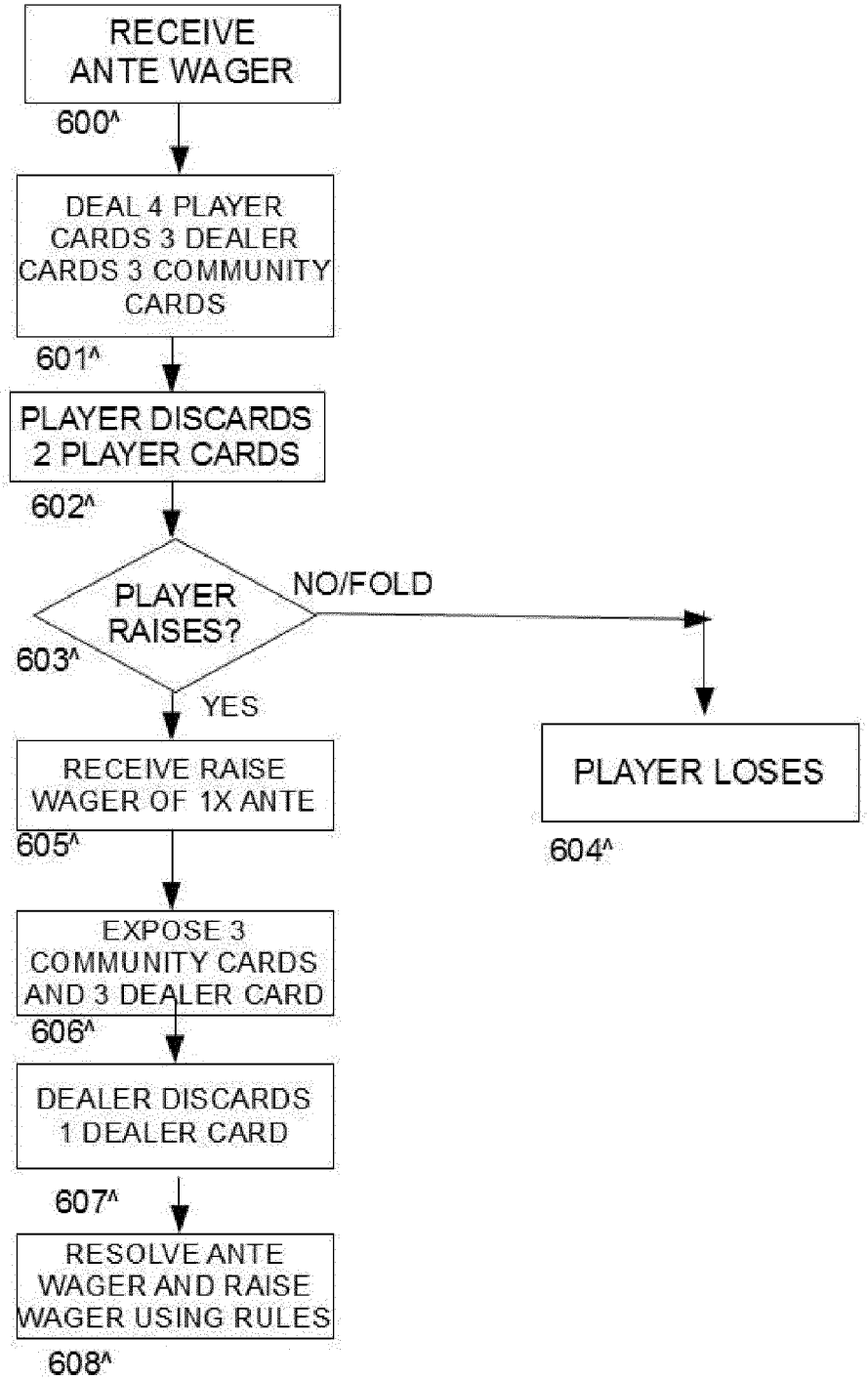
FIG. 6 is a flowchart illustrating an exemplary method of implementing an additional variation, according to an embodiment.

FIG. 6 is a flowchart illustrating an exemplary method of implementing an additional variation, according to an embodiment.

The method begins with operation 600, which receives an ante wager from the player.

From operation 600, the method proceeds to operation 601 which deals four cards to the player (either dealt face up or face down but all viewable by the player), three dealer cards (typically face down) and three community cards (typically face down). As with all embodiments herein, cards that are dealt face down can not be dealt yet and only dealt (face up) when needed. Note that any other numbers of cards can be used for the player, dealer and community cards. The four/three/three is merely one example.

From operation 601, the method proceeds to operation 602, wherein the player discards two of the player's cards out of the four player's cards at the player's choice.

From operation 602, the method proceeds to operation 603, which determines whether the player raises. If the player does not wish to raise, then the player folds and the method proceeds to operation 604 wherein the player loses his/her ante wager and the game ends.

If in operation 603, the player raises, then the method proceeds to operation 605, wherein the player places (the house/machine receives) a raise wager from the player equal in amount to the ante wager.

From operation 605, the method proceeds to operation 606, wherein all three community cards are exposed (either turned face up or are now dealt face up). Three dealer cards are also exposed (either turned face up or are now dealt face up).

From operation 606, the method proceeds to operation 607, wherein the dealer discards one dealer card. Note that in any embodiment herein, the dealer will always discard the cards in the dealer's hand to maximize the rank of the dealer's hand. In other words, the dealer will keep the card(s) that will give the dealer the best poker hand (poker hand with highest rank).

From operation 607, the method proceeds to operation 608, wherein the ante wager and the raise wager are resolved using the rules described herein (for example see operation 416. If the dealer does not qualify (with an ace-king or higher ranking hand) then the ante is pushed and the dealer resolves the raise bet (in the same manner as Table 5). If the dealer qualifies, then both the ante and raise are resolved in the same manner according to Table 5 (highest hand wins).

In one embodiment, the dealer must use all three community cards and two of the dealer's own cards to make the best five card poker hand (discarding one of the dealer's own cards).

In another embodiment, the dealer uses all six cards (the three community cards plus the three dealer's cards) to make the best five card poker hand, discarding one of the un-used cards. Thus, the dealer does not have to discard one of the dealer's cards and can not use (i.e. discard) one of the community cards.

Figure 7:
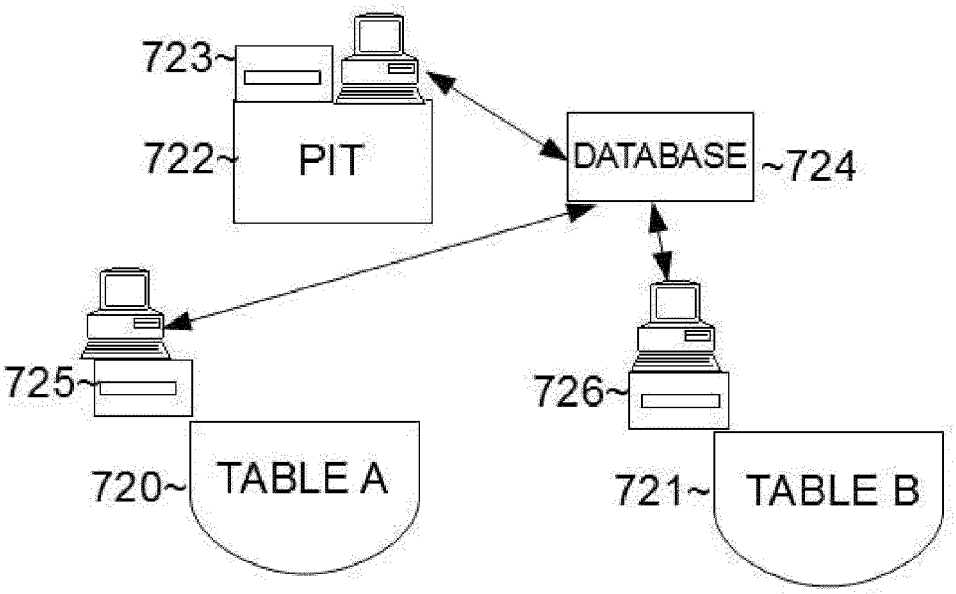
FIG. 7 is a block diagram illustrating an electronic player tracking system associated with each gaming table, according to an embodiment.

FIG. 7 is a block diagram illustrating an electronic player tracking system associated with each gaming table, according to an embodiment.

When players play casino table games the casino can typically track the player so that the casino knows how much gaming action a player is giving the casino and hence how much to reward each player with complimentaries (free or discounted rooms, food, etc.) Such a system is described in U.S. Pat. No. 5,836,817, which is incorporated by reference herein in its entirety for all purposes. Each player can have their own players card which is a plastic card that has their name imprinted on it and computer readable indicia (e.g., a magnetic stripe) which stores an identification number of the player's card (and hence the identification number of the player who owns the card). The player's card can be swiped through an electronic card readers 623, 625, 626 which can be electronic read and the data therein transmitted to the associated computer.

A gaming table A 720 (which can be used to play any method described herein) and a gaming table B 721 (which can be used to play any method described herein) can be associated with a pit 722 (which has its own computer) which has a card reader 723 to read the electronically encoded information on a player's card (the card reader can also be located at the tables themselves) and transmit the information to an associated computer which can communicate information contained on the player's card (e.g., an identification number of the player associated with the card) to the electronic database 724 along with play data relating to the player who owns the player's card. Table A 720 has its own card reader 725 and associated computer (the one next to card reader 725 which receives information from the card reader 725) and table B 721 also has its own card reader 726 and associated computer (the one next to card reader 726 which receives information from the card reader 726). The computers at table A 720 and table B 721 are connected to the electronic database 724. Casino employees can enter data regarding each player's play (for those players that present a players card) into a computer at the table or at the pit which transmits the play data (e.g., average bet amount, time of play, etc.) to the electronic casino database 724 that stores playing history information for players at the casino. The computers illustrated in FIG. 7 can all have the structure as illustrated in FIG. 8A.

Figure 8A:
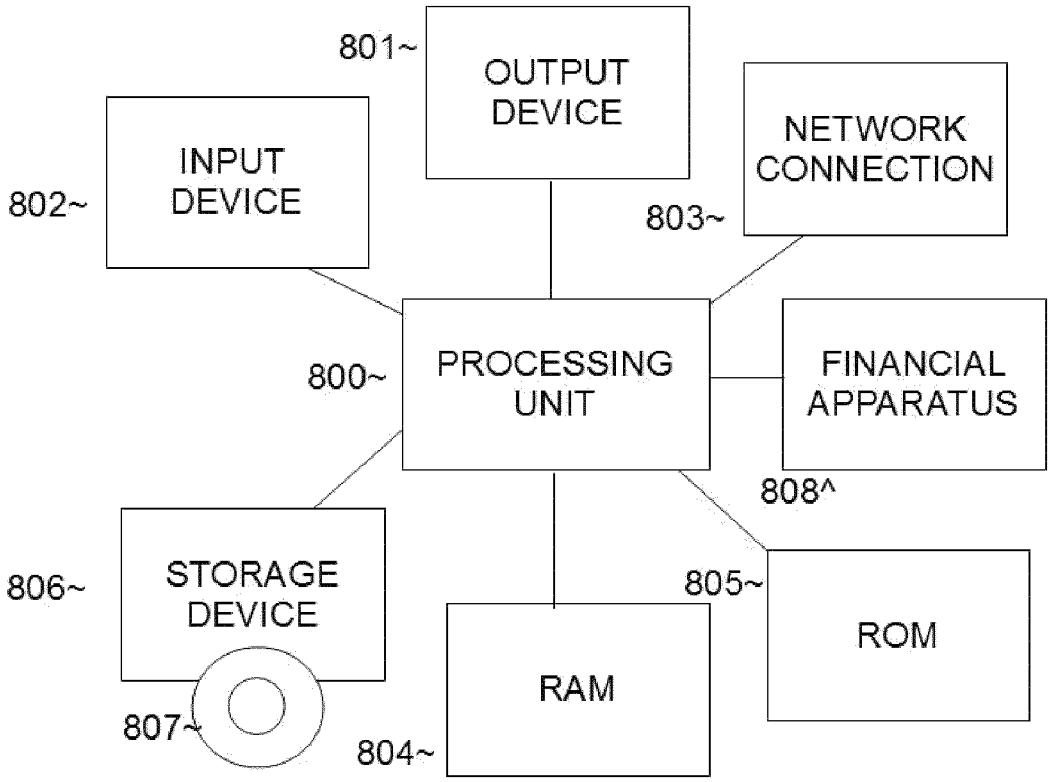
FIG. 8A is a block diagram illustrating hardware that can be used to implement electronic versions of the wagering methods described herein, according to an embodiment.

FIG. 8A is a block diagram illustrating hardware that can be used to implement electronic versions of the wagering methods described herein, according to an embodiment. The hardware can be, for example, an electronic gaming machine (EGM) used in casinos. The hardware can also be a personal computer, playing the game using the Internet at an Internet casino for real money. The hardware can also be a digital casino table, for example the kind described in U.S. Pat. No. 7,775,887, which is incorporated by reference herein in its entirety. The hardware can also be any computing device, such as a cellular phone, tablet, etc., and the methods described herein can be installed as software (e.g., an app) on the device. The hardware can also be any other type of device, working individually or in conjunction with other devices. The hardware can also be a digital poker table, of the kind described in U.S. Pat. No. 7,758,411 which is incorporated by reference herein in its entirety.

A processing unit 800 (such as a microprocessor and any associated components) is connected to an output device 801 (such as an LCD monitor, touch screen, CRT, etc.) which is used to display to the player any aspect of the method (including all cards, bet amounts, etc.), and an input device 802 (e.g., buttons, a touch screen, a keyboard, mouse, etc.) which can be used to input from the player any decision made by the player. All methods described herein can be performed by the processing unit 800 by loading and executing respective instructions. The processing unit 800 can also be connected to a network connection 803, which can connect the electronic gaming device to a computer communications network such as the Internet, a LAN, WAN, etc. The processing unit 800 is also connected to a RAM 804 and a ROM 805. The processing unit 800 is also connected to a storage device 806 which can be a DVD-drive, CD-ROM, flash memory, etc. Multiple such processing units can also work in collaboration with each other (in a same or different physical location). A non-transitory computer readable storage medium 807 can store a program which can control the electronic device to perform any of the methods described herein and can be read by the storage device 806. The processing unit 800 can also be connected to a financial apparatus 808 which can receive cash and convert the received cash into playable credits for use by the player when playing the electronic device. When the player decides to cash out any remaining credits, the financial apparatus 808 can issue coins or a cashless ticket (voucher) for the remaining credits which is redeemable by the player. The processing unit 800, can for example, perform all actions of the dealer electronically (dealing a card corresponds to displaying a random card from a virtual deck on the output device 801).

While one processing unit is shown, it can be appreciated that one or more such processor can work together (either in a same physical location or in different locations) to combine to implement any of the methods described herein. Programs and/or data required to implement any of the methods/features described herein can all be stored on any non-transitory computer readable storage medium (volatile or non-volatile, such as CD-ROM, RAM, ROM, EPROM, microprocessor cache, etc.)

Figure 8B:
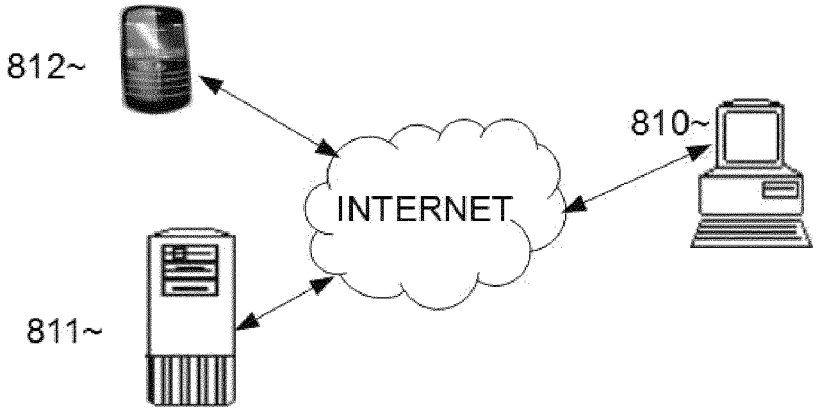
FIG. 8B is a block diagram illustrating an exemplary network configuration to implement a player playing an online version of the methods described herein.

FIG. 8B is a block diagram illustrating an exemplary network configuration to implement a player playing an online version of the methods described herein. All the methods described herein can be implemented on an online casino for real money (credits which are purchased for cash and are redeemable for cash) or for non-cash value credits. A player uses a personal computer 810 (e.g., cell phone, tablet, PC, etc.) can connect to a server 811 (which can have the structure illustrated in FIG. 8A) using a computer communications network such as the Internet. The server 811 hosts an online casino which determines the outcomes of the game and serves the outcomes to the computer 810 so the computer 810 displays the outcomes to the player. Other users can also play at the online casino hosted by the server 811 simultaneously, such as using a cell phone 812 with wireless internet connectivity. Any number of players connected to the internet can play contemporaneously at the sever 811. The general structure of online casinos is well known in the art.

It is noted that the methods described herein can be played with any number of standard decks of 52 cards (e.g., 1 deck to 10 decks). A standard deck is a collection of cards comprising an Ace, two, three, four, five, six, seven, eight, nine, ten, jack, queen, king, for each of four suits (comprising spades, diamonds, clubs, hearts) totaling 52 cards. Cards can be shuffled or a continuous shuffling machine (CSM) can be used. A standard deck of 52 cards can be used, as well as other kinds of decks, such as Spanish decks, decks with wild cards, etc. The operations described herein can be performed in any sensible order. Furthermore, numerous different variants of house rules can be applied.

Note that in the embodiments played using computers (a processor/processing unit), "virtual deck(s)" of cards are used instead of physical decks. A virtual deck is an electronic data structure used to represent a physical deck of cards which uses electronic representations for each respective card in the deck. A virtual card is displayed on an electronic output device using computer graphics and is displayed to mimic a real life image of that card.

Methods described herein can also be played on a physical table using physical cards and physical chips used to place wagers. Such physical chips can be directly redeemable for cash. When a player wins (dealer loses) the player's wager, the dealer will pay that player a respective payout amount. When a player loses (dealer wins) the player's wager, the dealer will take (collect) that wager from the player and typically place those chips in the dealer's chip rack. All rules, embodiments, features, etc. of a game being played are typically communicated to the player (e.g., verbally or on a written rule card) before the game begins.

Initial cash deposits can be made into the electronic gaming machine which converts cash into electronic credits. Wagers can be placed in the form of electronic credits, which can be cashed out for real coins or a ticket (e.g., ticket-in-ticket-out) which can be redeemed at a casino cashier or kiosk for real cash and/or coins.

While certain embodiments of the present invention have been shown and described it is to be understood that the present invention is subject to many modifications and changes without departing from the spirit and scope of the claims presented herein.

What is claimed is:

1. A method to play a wagering game using player cards, community cards, and dealer cards, the method comprising:

providing an electronic input device and an electronic output device;

providing an electronic bill acceptor;

providing a processing unit connected to the input device and the output device, the processing unit performing the following operations:

receiving a bill from the player in the bill acceptor and crediting the player;

receiving an ante wager from a player;

dealing the player cards and enabling the player to view the player cards;

offering the player a set of first options comprising 1) receiving a raise wager with a raise amount of a first multiple of the ante greater than one, and 2) checking;

receiving a first action from the player in the set of first options;

exposing at least one non-player card(s) which is one of at least one dealer card and at least one community card and at least one dealer card combined with at least one community card;

when the player has not exercised the raise option in the set of first options, offering the player a set of final options comprising 1) receiving the raise wager with the raise amount being a final multiple which is lower than the first multiple of the ante, and 2) folding where the player does not place the raise wager and loses the ante wager and the game ends, and receiving a final action from the player in the set of final options, the final action not being folding;

exposing all community cards and dealer cards;

forming a player hand comprising the player cards and the community cards;

forming a dealer hand comprising the dealer cards and the community cards; and resolving the ante wager and the raise wager based upon a relationship between a poker rank of the player hand and a poker rank of the dealer hand.

2. The method as recited in claim 1, further comprising, before the exposing at least one non-player card(s), enabling the player to select a discard out of the player cards and discarding the selected discard.

3. The method as recited in claim 1, wherein there are three player cards dealt to the player.

4. The method as recited in claim 3, wherein there are three community cards.

5. The method as recited in claim 4, wherein there are three dealer cards dealt to the dealer.

6. The method as recited in claim 1, further comprising, before the resolving, discarding one of the dealer cards.

7. The method as recited in claim 1, further comprising, along with the dealing the player cards, also dealing the community cards face down and dealing the dealer cards face down.

8. The method as recited in claim 1, wherein the community cards and the dealer cards are dealt when they are exposed.

9. The method as recited in claim 1, wherein if the dealer's hand does not qualify then the ante wager pushes.

10. The method as recited claim 1, wherein if the dealer's hand qualifies then the ante wager is paid in a same manner along with the raise wager.

11. The method as recited in claim 1, wherein if the poker rank of the dealer's hand is higher than the poker rank of the player's hand then the raise wager loses and is taken from the player.

12. The method as recited in claim 1, wherein if the poker rank of the dealer's hand is lower than the poker rank of the player's hand then the raise wager wins and is paid.

13. The method as recited in claim 1, wherein if the poker rank of the dealer's hand ties the poker rank of the player's hand then the raise wager pushes.

14. The method as recited in claim 1, wherein the exposing at least one non-player card(s) exposes only two community cards.

15. The method as recited in claim 1, further comprising, after the exposing at least one non-player card(s) and before the offering the player a set of final options, performing:

when the player has not exercised the raise option in the set of first options, offering the player an intermediate set of options comprising 1) receiving the raise wager with a raise amount of a second multiple of the ante less than the first multiple, and 2) checking, and receiving an intermediate action from the player in the set of first options; and exposing more at least one non-player card(s) which is one of at least one dealer card and at least one community card and at least one dealer card combined with at least one community card.

16. The method as recited in claim 15, wherein the final multiple is lower than the second multiple.

17. The method as recited in claim 15, wherein the exposing more at least one non-player card(s) exposes only one dealer card.

18. An apparatus to play a wagering game using player cards, community cards, and dealer cards, the apparatus comprising:

an electronic input device;

an electronic output device;

an electronic bill acceptor;

a processing unit connected to the input device and the output device, the processing unit configured to execute computer readable instructions stored on a non-transitory storage medium which are programmed to:

receive a bill from the player in the bill acceptor and credit the player;

receive an ante wager from a player;

deal the player cards and enabling the player to view the player cards;

offer the player a set of first options comprising 1) receiving a raise wager with a raise amount of a first multiple of the ante greater than one, and 2) checking;

receive a first action from the player in the set of first options;

expose at least one non-player card(s) which is one of at least one dealer card and at least one community card and at least one dealer card combined with at least one community card;

offer the player a set of final options comprising 1) receiving the raise wager when the player has not exercised the raise option in the set of first options with the raise amount being lower than the first multiple of the ante, and 2) folding where the player does not place the raise wager and loses the ante wager and the game ends;

receive a final action from the player in the set of final options;

expose all community cards and dealer cards;

form a player hand comprising the player cards and the community cards;

form a dealer hand comprising the dealer cards and the community cards; and resolve the ante wager and the raise wager based upon a relationship between a poker rank of the player hand and a poker rank of the dealer hand.

19. The apparatus as recited in claim 18, wherein the computer readable instructions are further programmed such that, after the exposing at least one non-player card(s) and before the offering the player a set of final options, to:

when the player has not exercised the raise option in the set of first options, offer the player an intermediate set of options comprising 1) receiving the raise wager with a raise amount of a second multiple of the ante less than the first multiple, and 2) checking, and receive an intermediate action from the player in the set of first options; and expose more at least one non-player card(s) which is one of at least one dealer card and at least one community card and at least one dealer card combined with at least one community card.

* * * * *